United States Patent [101]

Baker

[11] 4,052,755

[45] Oct. 11, 1977

[54] WAVE-QUELLING FLOAT

[76] Inventor: William H. Baker, 30 Honeysuckle Woods, Clover, S.C. 29710

[21] Appl. No.: 687,578

[22] Filed: May 18, 1976

[51] Int. Cl.[2] ..... E04H 3/16; E04H 3/18

[52] U.S. Cl. ..... 4/172; 9/8 R

[58] Field of Search ..... 4/172, 172.15; 9/8 R; 114/.5 F; 272/1 B

[56] References Cited

U.S. PATENT DOCUMENTS

| | | | |
|---|---|---|---|
| 3,498,246 | 3/1970 | Keifer | 9/8 R |
| 3,540,063 | 11/1970 | Stanwood | 4/172 |
| 3,755,829 | 9/1973 | Walklet | 4/172 |
| 3,786,521 | 1/1974 | Walklet | 4/172.15 |
| 3,793,657 | 2/1974 | Kaas | 9/8 R |
| 3,886,602 | 6/1975 | Stanwood | 4/172 |

*Primary Examiner*—Richard E. Aegerter
*Assistant Examiner*—Richard R. Stearns

[57] ABSTRACT

A wave-quelling float for marking lines extending across the surface of a body of water is provided, comprising a supporting body of lightweight plastic material; a hub in the body with a central passage therethrough for reception of a float-tethering marking line; a plurality of buoyant members arranged radially about the hub, and preferably disposed at regular intervals about the hub to float the body in a manner such that at least one-half the body is above the water with the float balanced for free rotation in the water about a float-tethering line; the body having a web portion extending radially from the hub, and a plurality of wave-quelling vanes extending laterally from the web on at least one side thereof; the vanes being spaced and shaped to receive surface surges and waves on the body of water, absorb the impact thereof as rotation of the float, and thereby quell them. The body of the float is preferably made in one piece of plastic, with pieces of buoyant material inserted in the float supports, and attached thereto.

45 Claims, 8 Drawing Figures

WAVE-QUELLING FLOAT

In competition racing swimming events, it is customary to mark out swimming lanes for the racers. This is done by stretching racing lines between floats. In swimming pools, these usually stretch from end to end of the pool. In larger bodies of water, they extend over the prescribed distance between floats or permanent markers.

The progress of a swimmer along the channels thus marked out is accompanied by surges and waves created by the swimmer, which fan out across adjacent channels. These interfere with the progress of slower swimmers in adjacent channels, and they also may deflect the racing lines slightly, bending the channel. Consequently, the art has long been seeking a float for a racing line which will not only support the line but will also quell the side wash created by swimmers in adjacent channels.

One of the earliest attempts to overcome this problem is described in U.S. Pat. No. 2,117,982 to Prince. Prince used a continuous line of substantially cylindrical corks, contiguously arranged to present a smooth, buoyant and yieldable body along the entire length of the line. A spring at the end of the line permitted deflection, but induced a rapid return of the deflected line to its normal position.

Kiefer U.S. Pat. Nos. 3,304,560, patented Feb. 21, 1967, and 3,498,246, patented Mar. 3, 1970, introduced the concept of a plurality of bodies having perforated wall surfaces extending above and below the water line interposed between the floats on the racing line. The perforations extended laterally of the body, so that the side wash entered the perforations directly, and in this manner the waves and surges were broken up, and their force dissipated. In cylindrical form, the quelling devices resembled a cylindrical lattice. Instead of being arranged cylindrically, the lattice structure could also be arranged in the form of vanes, extending radially from a central hub. Water encountering the vanes would flow through the openings in the vanes, and would at the same time tend to cause the body to revolve about the racing line, in a sort of paddle-wheel effect, additionally tending to modify and reduce water flow, and smooth out the wave form. Other modifications are suggested.

Stanwood U.S. Pat. No. 3,540,063, patented Nov. 17, 1970, described a form of turbulence-dispelling float having a housing supporting a plurality of spaced, ring-shaped members on impervious ribs. Stanwood explains that the Kiefer racing line float of the previously-described patents was inadequate, because the perforate surface merely breaks up a wave passing therethrough, instead of dampening or absorbing the shock impulse of the waves. Accordingly, Stanwood's device eliminates these openings, using solid cylindrical members, which are spaced apart.

Walklet U.S. Pat. No. 3,755,829, patented Sept. 4, 1973, provides a wave-suppression assembly which comprises a continuous series of open-faced perforated discs resembling spoked wheels, strung together in axially aligned and axially spaced relationship on a taut line or cable, so that each of the elements is independently freely rotatably about its central axis. This device is said to be more restrictive to irregular wake patterns or eddy currents than the Kiefer devices of U.S. Pat. Nos. 3,304,560 and 3,498,246, because the freely revolvable elements are not elongated. Elongated bodies, according to Walklet, tend to create a slight counter-turbulence back into the area where the waves were generated. The shorter length larger diameter disc-shaped bodies of the Walklet invention, due to their greatly reduced mass, have an effectively reduced inertia, and make possible a more localized control of small disturbances in the water. These devices are not floating, but they are supported on the racing line by a plurality of floats which are interposed therebetween, and the wave-quelling devices are shaped so as to receive the floats wholly within their interior, as seen in FIG. 4, so that a solid front of wave-quelling devices along the line can be presented.

Lowe, U.S. Pat. No. 3,849,807, patented Nov. 26, 1974, provides a wave suppressing device comprising a continuous ballast member that serves as a stabilizing element, and a continuous floatable member surrounding the ballast member, having a volume greater than the ballast member and a density less than the pool water. The continuous ballast member preferably is flexible tubing filled with water, while the continuous floatable member is flexible tubing filled with gas. However this device does not appear to be adapted to be linked together along a racing line, but is instead intended to quell waves at the sides of a confined body of water, such as a swimming pool.

Stanwood U.S. Pat. No. 3,886,602, patented June 3, 1975, provides a float for racing lines that is molded in one piece from plastic, with fin-like wafers uniformly spaced apart, and barrier elements normal to and extending between confronting faces of adjacent discs. Circumferentially of the discs, the barrier elements are in sets of four in quadrature, and longitudinally of the floats they are aligned to form four sets in quadrature. The floats have an axial bar, so that they may be strung on a line or cable. This float is said to be a considerable improvement on the device of Kiefer U.S. Pat. No. 3,540,063.

In accordance with the instant invention, a wave-quelling float is provided for marker lines, such as racing lines, extending across the surface of a body of water, such as a swimming pool, that comprises a supporting body of lightweight plastic material, a hub in the body with a central passage therethrough for reception of a float-tethering marking line; a plurality of buoyant members arranged radially about the hub, and preferably disposed at regular intervals about the hub, to float the body in a manner such that at least one-half the body is above the water with the float balanced for free rotation in the water about a float-tethering line; the body having a web portion extending radially from the hub and a plurality of wave quelling vanes extending laterally from the web on at least one side and preferably on both sides thereof; the vanes being spaced and shaped to receive surface surges and waves on the body of water, absorb the impact thereof as rotation of the float, and thereby quell them.

In a preferred embodiment, the body is made in one piece, with the buoyant members comprising float supports defining float channels in the body for reception of buoyant material, and the web extends from beyond the channels, as seen in FIGS. 1 to 6.

In another embodiment, seen in FIGS. 7 and 8, the buoyant members are air chambers in the body arranged about the hub, and the web extends from beyond the air chambers.

It is particularly preferred that the body have four vanes, arranged quadrilaterally, at 90° intervals, and four float supports, also disposed at 90° intervals quadrilaterally, about the hub. In this arrangement, the float at rest in the water floats with one vane straight up, and the next-adjacent vanes flat on the water, which is an optimum orientation for encountering and quelling waves and surges.

The vanes can be partially enclosed at either the inner or outer ends, or both, to trap side wash surges and waves proceeding at an angle to the float and improve the rotational response to such surges and waves. For the same reason, alternatively, or in addition, the web is preferably provided with a plurality of through apertures beyond the float supports that allow water to pass right through the web.

The wave-quelling float of the invention is adapted to be molded in one piece, of plastic, with float inserts of foam plastic material.

Several embodiments of the float in accordance with the invention are illustrated in the drawings, in which.

Figure 1:
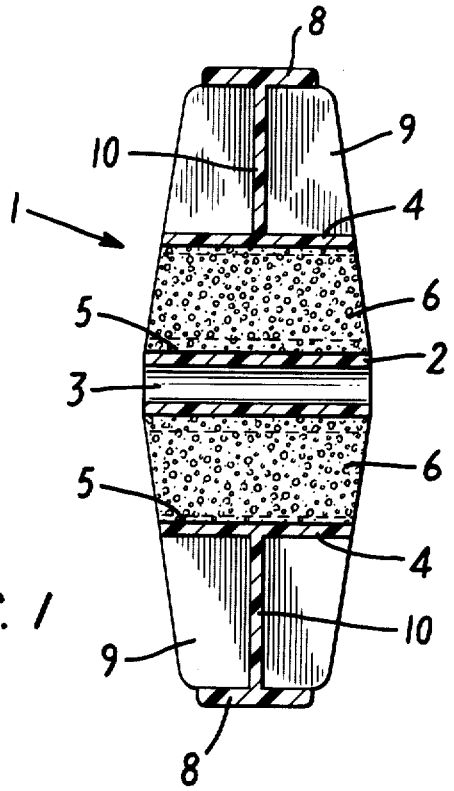
FIG. 1 represents a longitudinal section through an embodiment of wave quelling float of the invention with straight vanes.
Figure 2:
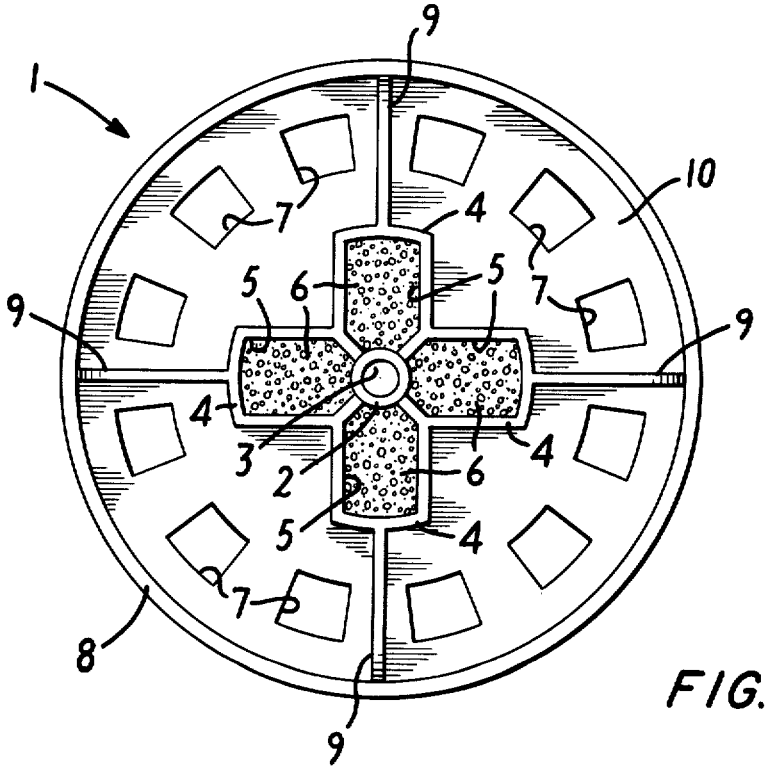
FIG. 2 represents a cross-sectional view through the float of FIG. 1.

The wave-quelling float of FIGS. 1 and 2 comprises a one-piece body 1 of molded lightweight plastic material, such as polyethylene, having a central hub 2 with a central passage 3 therethrough, for reception of a marker line, such as a racing line.

The molded plastic body 1 includes four float channels 5, defined by supports 4 and the hub 2, and distributed symmetrically and radially about the hub 2. Each float channel 5 has inserted therein and attached thereto by adhesive a block 6 of foamed plastic, such as foamed polyethylene. The blocks can be held securely in the channels in a press-fit, but bonding agents or adhesives are preferred, to ensure that the floats do not become separated from the body in turbulent water.

The channels 5 are sufficiently large to accommodate a sufficient volume of foamed material to float the body in water such that at least half of the float is above the surface of the water, and balance the float for free rotation in the water, no quadrant being heavier than any other quadrant.

Extending radially outwardly from the foam supports 4 is a disc-shaped web portion 10, with a plurality of apertures 7 therethrough. At the outer periphery of the web 10 and extending circumferentially is a cylindrical rim 8. Extending laterally from the web 10, four on each side thereof, at 90° spacing, between the float supports 4 and the rim 8, are straight vanes 9. These vanes are uniformly spaced at 90° intervals about the web, and are spaced to receive surface surges and waves on the body of water. The float supports 4 and rim 8 close off and support the ends of the vanes 9, so that surges and waves proceeding at an angle to the float are trapped in the recess defined by vanes 9, rim 8 and supports 4, for rotation of the float.

As best seen in FIG. 1, the body is shaped so that the width at the hub 2 is approximately twice the width at the rim 8. The vanes 9 taper outwardly, narrowing to a span slightly greater than the rim 8 at the outer periphery of the float. The float at rest rides on the water with one vane straight up and the two vanes next adjacent thereto float on the water.

A plurality of these floats are gathered together on the racing line, in closely-abutting contact. The side wash created by a swimmer in a channel between two lines carrying such floats is trapped in the pockets defined by vanes 9, web 10, rim 8 and supports 4. Part of the force of the waves rotates the float, and part of the water surges through the apertures 7, which thus is converted into vectors that also have a quelling effect, and permit the dissipation of force applied in a direction perpendicular to the vanes. As a result, the floats in accordance with the invention are adapted to quell waves proceeding at an angle to the racing line. Of course, they can also quell waves proceeding across the racing line, and in parallel to the line.

Figure 3:
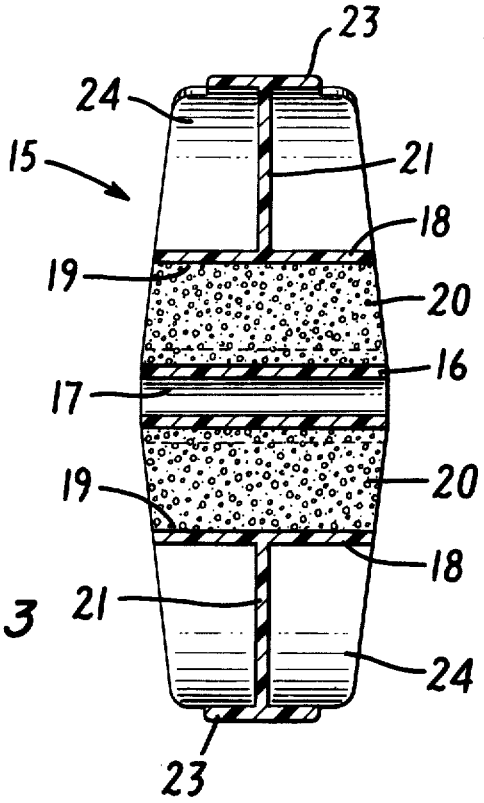
FIG. 3 represents a longitudinal section through another embodiment of wave quelling float in accordance with the invention, with curved vanes.
Figure 4:
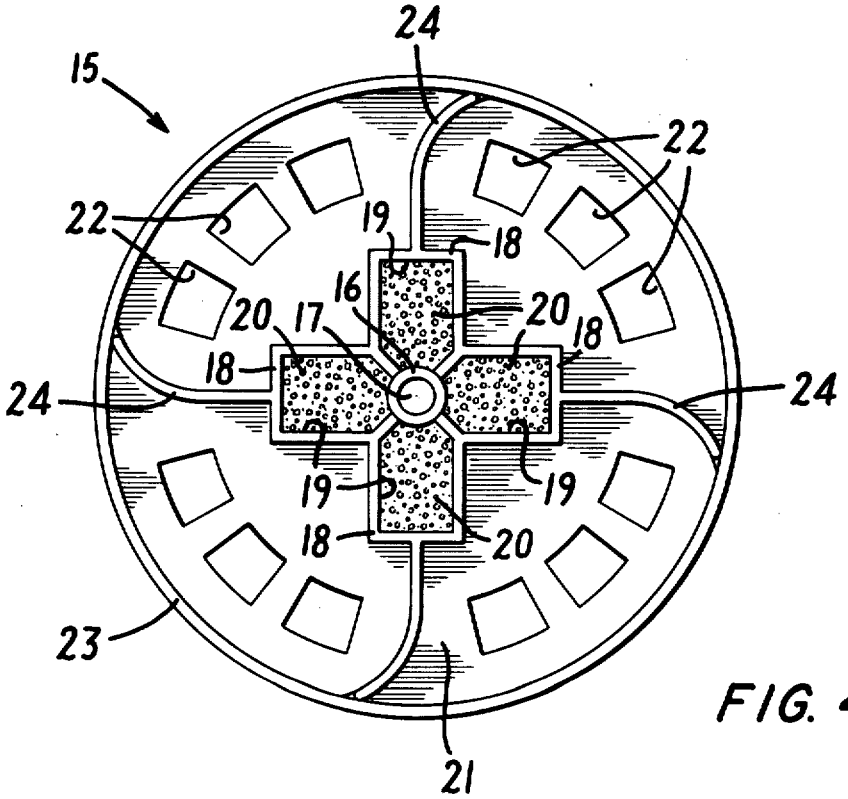
FIG. 4 represents a cross-sectional view through the float of FIG. 3.

The wave-quelling float of FIGS. 3 and 4 comprises a body 15 of lightweight plastic material, such as polyamide, having a central hub 16 with a central passage 17 therethrough, for reception of a racing line.

The molded plastic body 15 includes four float supports 18, distributed at 90° intervals radially about the hub 16. Each float support 18 defines a channel 19, which is inserted in a block 20 of foamed plastic, such as foamed polyamide, held securely in the channels in a press-fit, but bonding agents or adhesives can also be used, to ensure that the blocks do not become separated from the body.

The channels 19 are sufficiently large to accommodate a volume of foamed material 20 that is sufficient to float the body in water such that at least half of the float is above the surface of the water.

Extending radially outwardly from the foam supports 18 is a disc-shaped web portion 21, with a plurality of apertures 22 therethrough. At the outer periphery of the web, and extending circumferentially, is a cylindrical rim 23. Extending laterally from the web, four on each side, between the foam supports 18 and the rim 23, are curved vanes 24. These vanes are uniformly spaced at 90° intervals about the web 21 and are curved to improve rotational response to the surface surges and waves on the body of water.

As best seen in FIG. 3, the body 15 is shaped so that the width at the hub 16 is approximately twice the width at the rim 23. The vanes 24 taper, narrowing to a span slightly greater than the rim 23 at the outer periphery of the float. The float at rest rides on the water with one vane straight up and the two vanes next adjacent thereto float on the water.

A plurality of these floats are gathered together on the racing line in closely abutting contact. The side wash created by a swimmer in a channel between two lines carrying such floats strikes the vanes and also the web. The force of the waves against the vanes tends to rotate the float, while part of the water surges through the apertures 22, which also has a quelling effect, and permits the dissipation of force applied in a direction perpendicular to the vanes. As a result, the floats in accordance with the invention are adapted to quell waves proceeding not only sidewise across the racing line, but also at an angle to the racing line.

Figure 5:
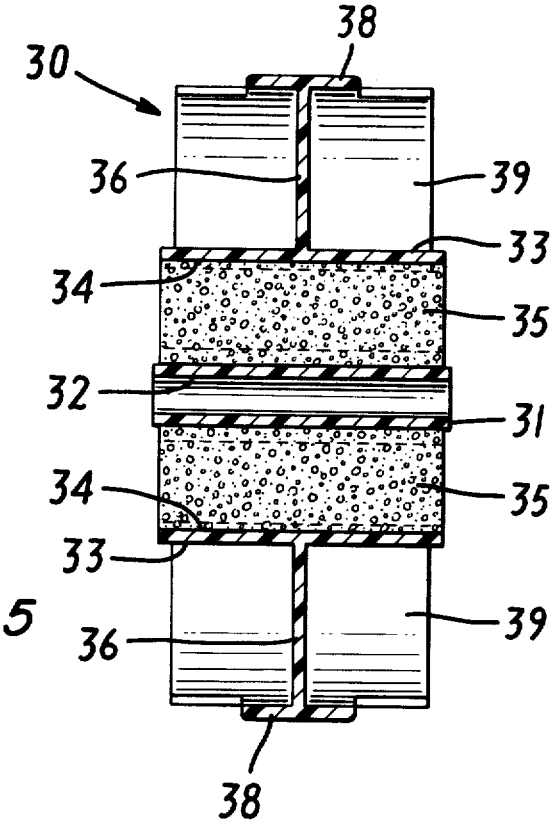
FIG. 5 represents a longitudinal section through another embodiment of wave quelling float in accordance with the invention, with double curved vanes.
Figure 6:
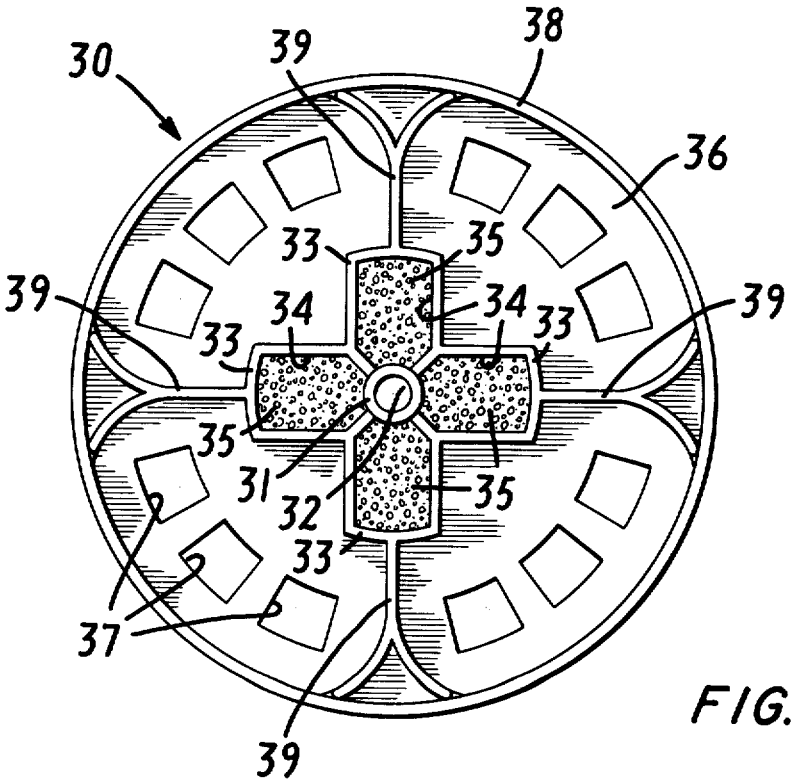
FIG. 6 is a cross-sectional view through the float of FIG. 5.

The wave-quelling float of FIGS. 5 and 6 comprises a body 30 of lightweight plastic material, such as polycarbonate, having a central hub 31 with a central passage 32 therethrough, for reception of a racing line.

The molded plastic body 30 has four float supports 33 distributed at 90° intervals radially about the hub. The hub 31 and float supports 33 define channels 34 in which are inserted blocks 35 of foamed plastic, such as foamed polypropylene, held securely in the channels in a press-fit, or by a bonding agent or adhesive.

The channels 34 are sufficiently large to accommodate a volume of foamed material that is sufficient to float the body in water such that at least half of the float is above the surface of the water.

Extending radially outwardly from the foam supports is a disc-shaped web portion 36, with a plurality of apertures 37 therethrough. At the outer periphery of the web and extending circumferentially is a cylindrical rim 38, and extending laterally from the web, four on each side between the float supports 33 and the rim 38, are double-curved vanes 39. These vanes are uniformly spaced at 90° intervals about the web, and are double-curved and bifurcated at the ends to receive surface surges and waves on the body of water, and rotate the float in either direction; they can respond to side wash from one side, and rotate in one direction; and can respond to side wash from the other side, and rotate in the opposite direction.

As best seen in FIG. 5, the body is shaped so that the vanes 39 have the same width at the float supports 33 as at the rim 38, but the rim is narrow to allow the waves and surges to encounter the full span of the vanes from their outer ends. The float at rest rides on the water with one vane straight up and the two vanes next adjacent thereto float on the water.

A plurality of these floats are gathered together on the racing line in closely abutting contact. A wave created by a swimmer in a channel between two lines carrying such floats strikes the vanes and also the web. The force of the water against the vanes tends to rotate the float in one direction, while some of the water passes through the apertures 37, which also has a quelling effect, and permit the dissipation of force applied in a direction perpendicular to the vanes. When the side wash hits the outer side of a float already rotating in one direction, the double curve in the vanes converts this force into a force tending to rotate the float in the opposite direction, increasing the quelling effect.

Figure 7:
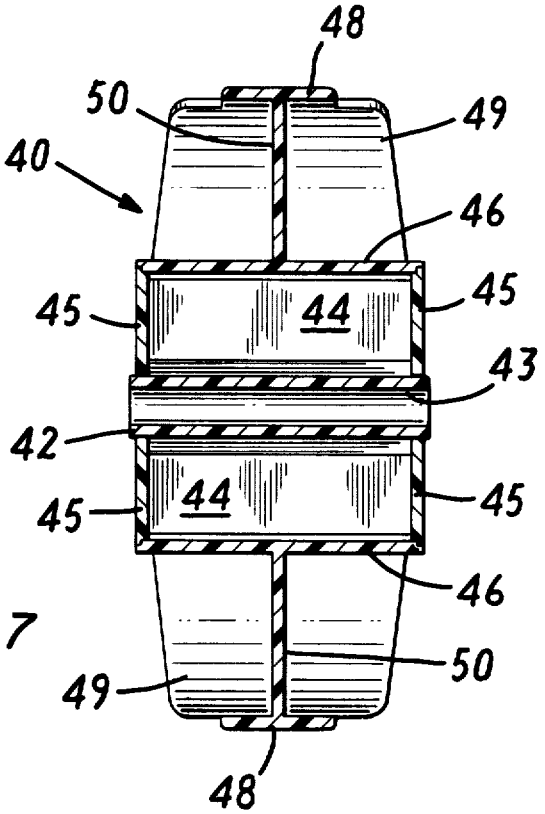
FIG. 7 represents a longitudinal section through another embodiment of wave quelling float in accordance with the invention, with air chambers as the buoyant members.
Figure 8:
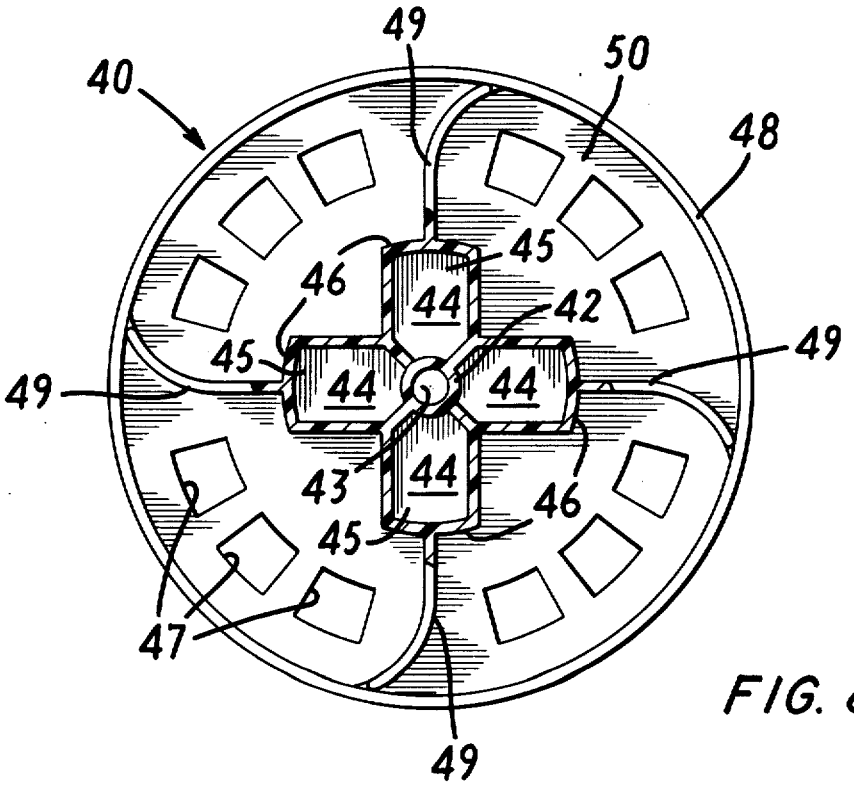
FIG. 8 is a cross-sectional view through the float of FIG. 7.

The wave-quelling float of FIGS. 7 and 8 comprises a one-piece body 40 of molded lightweight plastic material, such as polyethylene, having a central hub 42 with a central passage 43 therethrough, for reception of a marker line, such as a racing line.

The molded plastic body 40 has four air chambers 44 distributed symmetrically at 90° intervals radially about the hub 42, and at each end by caps 45 fusion welded to the walls 46 of the chambers 44. The interior of each chamber 44 is fully open, large enough to float the body.

The chambers 44 are sufficiently large to float the body in water such that at least half of the float is above the surface of the water, and are the same in volume, so as to balance the float for free rotation in the water, no quadrant being heavier than any other quadrant. The float at rest rides on the water with one vane straight up and the two vanes next adjacent thereto float on the water.

Extending radially outwardly from the outer peripheral walls 46 of chambers 44 is a disc-shaped web portion 50, with a plurality of apertures 47 therethrough. At the outer periphery of the web 50 and extending circumferentially is a cylindrical rim 48. Extending laterally from the web 50, four on each side thereof, at 90° spacing, between the walls 46 and the rim 48, are curved vanes 49. These vanes are uniformly spaced at 90° intervals about the web, and are spaced to receive surface surges and waves on the body of water. The walls 46 and rim 48 close off and support the ends of the vanes 49, so that surges and waves proceeding at an angle to the float are trapped in the recess defined by vanes 49, rim 48 and walls 46, for rotation of the float.

As best seen in FIG. 7, the body is shaped so that the width at the hub 42 is approximately twice the width at the rim 48. The vanes 49 taper outwardly, narrowing to a span slightly greater then the rim 48 at the outer periphery of the float.

A plurality of these floats are gathered together on the racing line, in closely-abutting contact. The side wash created by a swimmer in a channel between two lines carrying such floats is trapped in the pockets defined by vanes 49, web 50, rim 48 and walls 46. Part of the force of the waves rotates the float, and part of the water surges through apertures 47, which thus is converted into vectors that also have a quelling effect, and permit the dissipation of force applied in a direction perpendicular to the vanes. As a result, the floats in accordance with the invention are adapted to quell waves proceeding at an angle to the racing line. Of course, they can also quell waves proceeding across the racing line, and in parallel to the line.

Any type of plastic material can be used for the manufacture of the body of these floats. Lightweight materials are preferred, preferably lighter than water. Plastics materials which can be used include polyethylene, polypropylene, polybutylene, polyamide, polyester, polycarbonate, phenolformaldehyde resins, urea-formaldehyde resins and melamine-formaldehyde resins. While extrusion and other molding techniques permit forming the floats in a one-piece body, with the only additional component being the buoyant material inserted in the float channels thereof, the floats can also be built up of a plurality of pieces bonded together. Thus, for example, a disc of plastic material can be drilled so as to provide an aperture for reception of a tube comprising the hub, with a plurality of spokes defining the float supports. An annulus or ring can be bonded to the disc at the outer periphery, to constitute the rim, and the vane members can then be inserted and bonded thereto at their sides and ends. Other construction techniques will be apparent to those skilled in the art.

Having regard to the foregoing disclosure, the following is claimed as the incentive and patentable embodiments thereof:

1. A wave-quelling float for marker lines extending across the surface of a body of water comprising a supporting body of lightweight plastic material; the float body comprising a hub and a web portion extending radially of and circumferentially about the hub; a central passage through the hub for reception of a float-tethering marking line; a plurality of buoyant members attached to the body and disposed at regular intervals about the hub in a manner to float the body such that at least one-half the body is above the water with the float balanced for free rotation in the water about a float-tethering line extending through the passage of the hub; and a plurality of wave-quelling vanes extending laterally from the web on at least one side thereof; the vanes being spaced and generally flat, and defining a plane at their inner portions, and being curved away from that plane at their outer ends so as to receive surface surges and waves on the body of water, absorb the impact thereof as rotation of the float, and thereby quell them.

2. A wave-quelling float in accordance with claim 1, having a plurality of wave-quelling vanes extending laterally from both sides of the web.

3. A wave-quelling float in accordance with claim 1, in which the vanes have a flange extending laterally at their ends to trap side wash surges and waves proceeding at an angle to the float and improve the rotational response to such surges and waves.

4. A wave-quelling float in accordance with claim 3, in which the hub carries a plurality of float supports, and the vane ends terminate at an extension of the float supports and a peripheral rim extending circumferentially about the web.

5. A wave-quelling float in accordance with claim 1, in which the vanes are curved and bifurcated at least at their outer ends.

6. A wave-quelling float in accordance with claim 5, in which the plastic is polyethylene.

7. A wave-quelling device in accordance with claim 1, in which the buoyant members comprise float channels carrying foamed plastic material.

8. A wave-quelling float in accordance with claim 7, in which the foamed plastic material is foamed polyethylene.

9. A wave-quelling float in accordance with claim 7, having at 90° intervals about the hub four buoyant members and four vanes on each side of the web.

10. A wave-quelling float in accordance with claim 1, in which the supporting body is molded in one piece.

11. A wave-quelling float in accordance with claim 1, in which the web at its outer periphery is provided with a rim extending circumferentially about the web.

12. A wave-quelling float in accordance with claim 1, in which the web is apertured.

13. A wave-quelling float in accordance with claim 12, in which the apertures are uniformly distributed between the vanes about the outer periphery of the web.

14. A wave-quelling float in accordance with claim 1, in which the web is in the form of a disc, with a cylindrical rim extending about its outer periphery, and with vanes extending laterally from the disc on each side thereof.

15. A wave-quelling float in accordance with claim 14, in which the vanes and buoyant members extend quadrilaterally at 90° intervals about the hub.

16. A wave-quelling float for marker lines extending across the surface of a body of water comprising a supporting body of lightweight plastic material; the float body comprising a hub and a web portion extending radially of and circumferentially about the hub; a central passage through the hub for reception of a float-tethering marking line; a plurality of float supports in the body, arranged radially about the hub a plurality of buoyant members carried by the float supports, and the float supports and buoyant members being disposed at regular intervals about the hub in a manner to float the body such that at least one-half the body is above the water with the float balanced for free rotation in the water about a float-tethering line; and a plurality of wave-quelling vanes extending laterally from the web in radial alignment with the float supports on at least one side thereof; the vanes being spaced and shaped to receive surges and waves on the body of water, absorb the impact thereof as rotation of the float, and thereby quell them.

17. A wave-quelling float in accordance with claim 16, having a plurality of wave quelling vanes extending laterally from both sides of the web.

18. A wave-quelling float in accordance with claim 16, in which the vanes have a flange extending laterally at their ends to trap side wash surges and waves proceeding at an angle to the float and improve the rotating component of such surges and waves.

19. A wave-quelling float in accordance with claim 18, in which the hub carries a plurality of float supports, and the vane ends terminate at an extension of the float supports and a peripheral rim extending circumferentially about the web.

20. A wave-quelling float in accordance with claim 16, in which the vanes are generally flat and define a plane at their inner portions and are curved away from that plane at their outer ends.

21. A wave-quelling float in accordance with claim 16, in which the vanes are straight.

22. A wave-quelling float in accordance with claim 16, in which the vanes are generally flat and define a plane at their inner portions and are curved away from that plane and bifurcated at their outer ends.

23. A wave-quelling float in accordance with claim 16, in which the buoyant members are of foamed plastic material.

24. A wave-quelling float in accordance with claim 23, in which the foamed plastic material is foamed polyethylene.

25. A wave-quelling float in accordance with claim 16, in which the supporting body is molded in one piece.

26. A wave-quelling float in accordance with claim 25, in which the plastic is polyethylene.

27. A wave-quelling float in accordance with claim 26, having four buoyant members and four vanes on each side of the web, at 90° intervals about the hub.

28. A wave-quelling float in accordance with claim 16, in which the web at its outer periphery is provided with a rim extending circumferentially about the web.

29. A wave-quelling float in accordance with claim 16, in which the web is apertured.

30. A wave-quelling float in accordance with claim 29, in which the apertures are uniformly distributed between the vanes about the outer periphery of the web.

31. A wave-quelling float in accordance with claim 16, in which the web is in the form of a disc, with a cylindrical rim extending about its outer periphery, and with the vanes extending laterally from the disc on each side thereof.

32. A wave-quelling float in accordance with claim 21, in which the vanes and float supports extend quadrilaterally at 90° intervals about the hub.

33. A wave-quelling float for marker lines extending across the surface of a body of water comprising a supporting body of lightweight plastic material; the float body comprising a hub and a web portion extending radially of and circumferentially about the hub; a central passage through the hub for reception of a float-tethering marking line; a plurality of air chambers in the body disposed at regular intervals about the hub in a manner to float the body such that at least one-half the body is above the water with the float balanced for free rotation in the water about a float-tethering line extending through the passage in the hub; the air chambers extending through the body and having open ends and end caps closing off the open ends; and a plurality of wave-quelling vanes extending laterally from the web on at least one side thereof; the vanes being spaced and shaped to receive surface surges and waves on the body of water, absorb the impact thereof as rotation of the float, and thereby quell them.

34. A wave-quelling float in accordance with claim 33, having a plurality of wave-quelling vanes extending laterally from both sides of the web.

35. A wave-quelling float in accordance with claim 33, in which the vanes have a flange extending laterally at their ends to trap side wash surges and waves proceeding at an angle to the float and improve the rotating component of such surges and waves.

36. A wave-quelling float in accordance with claim 35, in which the vane ends terminate at a peripheral rim extending circumferentially about the web.

37. A wave-quelling float in accordance with claim 33, in which the vanes are generally flat and define a plane at their inner portion and are curved away from that plane at their outer ends.

38. A wave-quelling float in accordance with claim 33, in which the vanes are straight.

39. A wave-quelling float in accordance with claim 33, in which the vanes are generally flat and define a plane at their inner portions and are curved away from the plane and bifurcated at their outer ends.

40. A wave-quelling float in accordance with claim 33, in which the body has at 90° intervals four air chambers and the web has at 90° intervals four vanes on each side thereof.

41. A wave-quelling float in accordance with claim 33, in which the web at its outer periphery is provided with a rim extending circumferentially about the web.

42. A wave-quelling float in accordance with claim 33, in which the web is apertured.

43. A wave-quelling float in accordance with claim 42, in which the apertures are uniformly distributed between the vanes about the outer periphery of the web.

44. A wave-quelling float in accordance with claim 33, in which the web is in the form of a disc, with a cylindrical rim extending about its outer periphery, and with the vanes extending laterally from the disc on each side thereof.

45. A wave-quelling float in accordance with claim 44, in which the vanes and air chambers extend quadrilaterally at 90° intervals about the hub.

* * * * *